United States Patent [19]

Price

[11] Patent Number: 4,711,379

[45] Date of Patent: Dec. 8, 1987

[54] PROPORTIONAL FLOW CONTROL DISPENSING GUN

[75] Inventor: Richard P. Price, Parma Heights, Ohio

[73] Assignee: Nordson Corporation, Westlake, Ohio

[21] Appl. No.: 840,501

[22] Filed: Mar. 17, 1986

Related U.S. Application Data

[63] Continuation of Ser. No. 719,415, Apr. 3, 1985, abandoned.

[51] Int. Cl.[4] ..... B67D 5/00

[52] U.S. Cl. ..... 222/504; 222/146.5; 137/625.64; 251/129.07; 91/363 R; 91/387

[58] Field of Search ..... 222/146.5, 504; 91/35, 91/363 R, 372, 373, 387; 251/30.01, 129.01, 129.06, 129.07; 137/625.64

[56] References Cited

U.S. PATENT DOCUMENTS

| | | | |
|---|---|---|---|
| 2,851,997 | 9/1958 | De Mott et al. | 222/146.5 X |
| 3,410,301 | 11/1968 | Merriner et al. | 137/269 |
| 3,434,690 | 3/1969 | Troncale, Sr. | 251/30 |
| 3,464,627 | 9/1969 | Huber | 239/96 |
| 3,555,970 | 1/1971 | Borgeson et al. | 91/363 R X |
| 3,643,699 | 2/1972 | Mason | 137/625.64 |
| 3,757,823 | 9/1973 | Knutson | 137/625.64 |
| 3,779,426 | 12/1973 | Mawby | 222/146.5 X |
| 3,817,150 | 6/1974 | Cox | 91/186 |
| 3,827,603 | 8/1974 | Reighard et al. | 222/146.5 |
| 3,945,399 | 3/1976 | Tirelli | 137/529 |
| 3,961,608 | 6/1976 | Hertfelder | 123/119 A |
| 4,066,188 | 1/1978 | Scholl et al. | 222/146.5 |
| 4,232,517 | 11/1980 | Sumiyoshi et al. | 60/276 |
| 4,360,132 | 11/1982 | Vilagi et al. | 222/504 |
| 4,464,976 | 8/1984 | Tyler | 91/387 X |
| 4,465,212 | 8/1984 | Boone | 222/504 |

FOREIGN PATENT DOCUMENTS

| | | |
|---|---|---|
| 2327263 | 1/1974 | Fed. Rep. of Germany . |
| 203236 | 10/1983 | Fed. Rep. of Germany . |
| 1325091 | 8/1973 | United Kingdom . |
| 2049228 | 12/1980 | United Kingdom . |

OTHER PUBLICATIONS

Blackburn, J. F., Reethof, G. and Shearer, J. L., *Fluid Power Control,* the MIT Press and Wiley, 1960, pp. 403–406.

Fluid Power Control by John F. Blackburn, et al., Copyright 1960 by The Massachussetts Institute of Technology, Library of Congress #59-6759, pp. 408–432.

Moog Inc. Controls Division, Aurora, N.Y., 14052, Technical Bulletin #141, pp. 1–7.

Badger Meter, Inc., Research Control Valves, "The Small Valves for Small Flows".

*Primary Examiner*—Joseph J. Rolla
*Assistant Examiner*—Edward S. Ammeen
*Attorney, Agent, or Firm*—Wood, Herron & Evans

[57] ABSTRACT

A remote control proportional flow adhesive dispensing gun is pneumatically actuated and electrically controlled. An electric current applied to a magnetic torquemotor rotates a torquemotor arm which displaces the spool of a three-way air valve, admitting air to a control valve stem actuating piston. A constant rate feedback spring directly disposed between the actuating piston and the torque arm of the torquemotor acts to restore the air valve spool to an equilibrium non-flow position as the control valve stem approaches a position proportional to torquemotor control current. The air valve exhausts air from the piston and return springs close the control valve when control signal is removed. A shaped control plug attached to the flow control valve stem varies a control opening linearly as stem position changes. A nozzle opening is selected which coordinates with the greatest possible control opening, such that flow is more nearly linearly proportioned to torquemotor control current across the full range of openings in a constant pressure adhesive supply system. The gun body is electrically heated and thermostatically controlled.

2 Claims, 3 Drawing Figures

PROPORTIONAL FLOW CONTROL DISPENSING GUN

This is a continuation of application Ser. No. 719,415, filed Apr. 3, 1985, now abandoned.

This invention relates to the dispensing of fluids and more particularly to the remote proportional control of adhesive flow in a dispensing apparatus.

When dispensing liquids onto substrates, it is frequently necessary to precisely control the flow of the liquid being dispensed in order to produce a desired coating or application result. For example, when hot melt adhesive is dispensed onto a substrate, it may be desirable to maintain a constant adhesive bead width. When the speed of the dispenser or substrate varies, adhesive flow must also vary if constant adhesive bead width is to be maintained. Thus, it may be desirable to control the flow of such adhesive in proportion to the speed of the dispenser or substrate. Even when the dispenser and substrate speeds remain constant, it may be desirable for other reasons to vary bead width in proportion to remote manual control settings or control signal levels from a programmable controller or computer. In each instance, a proportional flow control device with remote control capability is required.

While various proportional flow control valves have been proposed, achieving all of the desired control features and characteristics for hot melt adhesive dispensing may be elusive. Furthermore, the construction may not be suitable for the dispensing environment, or the size and weight may be excessive.

For example, some valves are pneumatically actuated and pneumatically controlled from a remote I/P transmitter. The speed of response is often slow due to delays introduced by long control air lines. Moreover, such systems frequently employ flapper-nozzle air control elements which are highly wasteful of air, since they continuously bleed to atmosphere when in a balanced position.

Other valves are actuated by electric motors and controlled entirely by remote electrical signals, avoiding the air line delays associated with pneumatic control systems. Motor drive systems, however, may still be too slow in response for adhesive dispensing.

Especially in the case of high temperature hot melt adhesive systems, such valve devices may suffer from unwanted variation in flow due to temperature changes. These temperature changes may stem from a lack of heaters and temperature controls at the valve body or from changes in the inlet temperature of the dispensed medium. Temperature changes can alter control forces and displacements or change the viscosity of the dispensed medium, all of which may cause flow changes. Furthermore, where such valves are not constructed entirely of high temperature materials suitable for the dispensing temperature, the accuracy, durability or ultimate longevity may be affected.

Frequently the size, weight or physical construction of such valve devices may limit their use, especially where the dispenser gun is movable. For example, if the gun is connected to the extreme end of a robot dispensing arm, access to a workpiece may be hindered by the size or shape; machine capacity may be exceeded by the weight, or machine acceleration may be limited by the inertia. Moreover, unless movable control components are balanced or very tightly retained, rapid acceleration, inclination or vibration of the valve structure may cause undesirable flow changes. A further limitation may occur if external pressure transmitters or control air lines are required, since their added bulk and complexity may hinder installation and positioning of the gun.

An important consideration in any accurate remote proportional flow control is the flow characterization, which is the proportionality observed between control signal amplitude and valve flow. Characterization is established by the stem displacement-to-control area relationship, which is fixed by the shape of the flow control plug and the electrical and mechanical construction of the valve stem positioning mechanism. Common characterizations are of the linear, semi-logarithmic or modified semi-logarithmic form. Any additional fluid restrictions in the flow path may affect the flow characterization. For example, a dispensing nozzle attached to the valve will reduce flow when the pressure drop across the nozzle becomes an appreciable fraction of the pressure drop across the control opening. Therefore, a fixed nozzle opening should be properly coordinated with a maximum possible control opening to achieve a linear proportionality between the opening of a valve and a controlled flow through the valve. Furthermore, it should be understood that pressure drop across a valve is the principal determinant of flow, and therefore must be held constant to achieve flow repeatability at a given control setting.

Accordingly, it has been one object of this invention to provide an improved proportional flow control apparatus.

A further objective of the invention has been to provide an improved electrically controlled proportional flow dispensing gun for hot melt adhesives.

A further objective of the invention has been to provide a temperature controlled proportional flow dispensing gun for hot melt adhesives and other high temperature fluids with the gun providing a flow varying linearly and repeatably in response to corresponding control inputs.

A further objectve of the invention has been to provide a proportional flow dispensing gun having a fast response to control inputs to produce rapid and linear flow variations.

A further objective of the invention has been to provide a compact and lightweight proportional flow dispensing gun with increased resistance to flow changes caused by the effects of acceleration and vibration and inclination.

To these ends, a preferred embodiment of the invention includes a dispensing gun for hot melt adhesives wherein a flow controlling valve stem is positioned by air pressure and controlled by an electric signal to a linear effort magnetic torquemotor. A torque arm attached to the torquemotor engages a three-way air valve spool which governs the flow of pressurized air to a single-acting valve stem actuating piston. A constant rate stem position feedback spring, flexibly disposed between the actuating piston and the torque arm, restores the air valve spool to a centered no-flow condition when the valve stem approaches a rest position which is linearly proportional to torquemotor control current. Feedback and torquemotor springs reposition the air valve spool to exhaust air from the piston when control signal is removed, and a return spring closes the valve when the piston is exhausted. A linear flow control plug attached to the valve stem varies the area of a flow control opening in direct proportion to the position of the valve stem, and therefore in direct proportion to control current.

This air actuated and electrically controlled mechanical feedback apparatus produces a stable and repeatable proportional flow dispensing gun with quick acting response to control signals and reduced air consumption at balance. Also the combination of air actuation and electric control provides a very compact and lightweight gun with stiff closed loop response and without the transmission delays associated with traditional pneumatic remote control systems.

A preferred embodiment of the invention also includes a dispensing nozzle selected to have a cross sectional area equal to or greater than the maximum area of the variable flow control opening such that the pressure drop across the nozzle is minimized and the flow more linearly proportioned to torquemotor current across the full range of valve openings from closed to fully open.

Also, a preferred embodiment of the invention includes a dispensing gun with an electrically heated and thermostatically controlled gun body to minimize flow variation caused by temperature related viscosity changes in the dispensed adhesive or dimensional and force changes in the control mechanism.

These and other advantages will be readily apparent from the following detailed description of a preferred embodiment of the invention and from the drawings in which.

Figures 1, 2, 3:
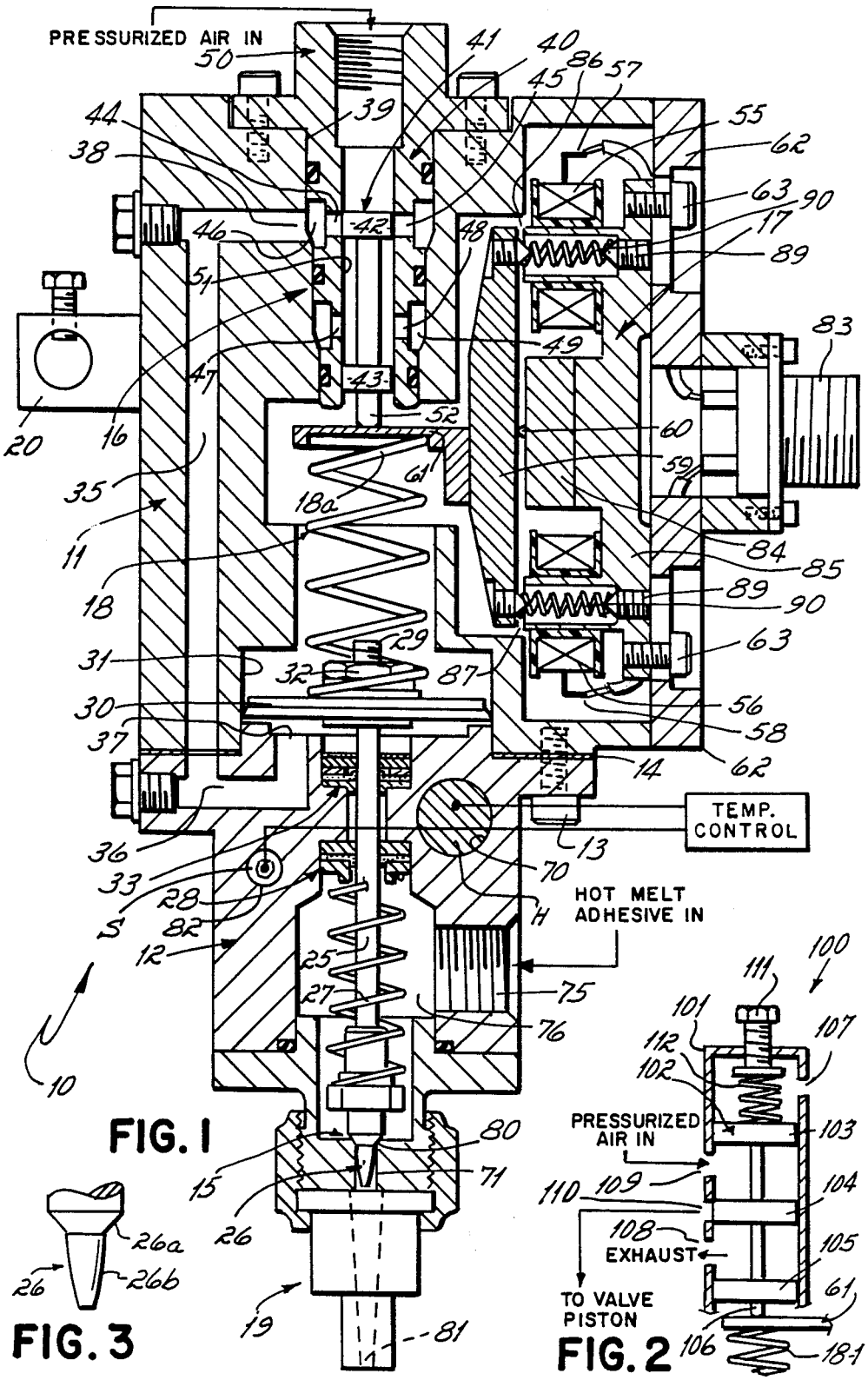
FIG. 1 is a cross-sectional view of a proportional flow dispensing gun according to the invention.
FIG. 2 is a diagrammatic view in cross section of an alternate air control valve.
FIG. 3 is an enlarged view of a linear flow control plug for the proportional flow dispensing gun illustrated in FIG. 1.

Turning now to the drawings, there is shown in FIG. 1 a proportional flow control dispensing gun 10 according to a preferred embodiment of the invention. Gun 10 has an upper body 11 and a lower body 12, these two bodies being joined and sealed together by appropriate bolts 13 and gasket 14, as shown. Gun 10 further includes a flow control valve 15, a three-way air valve 16, a magnetic torquemotor 17 and a valve stem position feedback spring 18. The gun 10 also includes a nozzle 19, downstream of the flow control valve 15.

As shown in FIG. 1, the gun 10 also includes a bracket 20 which functions for the purpose of mounting the gun on any suitable support structure (not shown) for dispensing hot melt adhesive onto substrates or articles as desired.

Preferably, the gun 10 is of compact size and weight, being approximately 6 inches high, 2 inches wide, 5 inches deep and weighing about 2½ pounds. Design fluid working pressure is about 1500 psig and nominal air actuating pressure is about 50 psig. Maximum design operating temperature is about 400° F.

Of course, the invention can be used for dispensing other fluids in other environments as well and the detailed description of the preferred embodiment for dispensing hot melt adhesives is for illustration.

Turning now to more specific details, the lower body 12 encloses the main adhesive flow control valve 15. Flow valve 15 includes a valve stem 25, a control plug 26 at the lower end thereof, and a return spring 27 extending between the lower end of the stem 25 and the upper packing 28. Body 12 is also provided with a bore 70 into which is inserted an electrical heater cartridge H and a bore 82 into which is inserted an electrical resistance temperature sensor S. The heater cartridge and temperature sensor, together and in conjunction with a remote temperature controller, comprise a system for heating and maintaining lower body 12 and any adhesive therein at a constant operating temperature.

The control plug of the valve stem 25 preferably constitutes a specially tapered stainless steel control plug 26 operating in a 0.107 inch diameter cylindrical control bore 71, and seating on a conical seat 80. Nominal control stroke is approximately ¼ inch.

The upper end of the valve stem 25 is operatively secured to a piston 30 which is sealed to a bore 31 in the upper body 11. The stem 25 can be threaded, as at 29, and secured to the piston 30 by a nut 32, as shown. Packing 33, together with the packing 28, prevents any fluid from entering the bore 31.

An air passageway 35 is provided in the upper body 11 and is operably connected to air passageway 36 in the lower body 12. Air passageway 36 opens at port 37 to the underside of the piston 30. Air passageway 35 opens at port 38 in the upper body 11 to a bore 39 containing the air valve 16.

Air valve 16 includes a valve body 40 and a movable spool 41 therein. Spool 41 has two sealing lands 42 and 43. Body 40 is also provided with radial ports 44 and 45 communicating with the annular chamber 46 and through that chamber with port 38 of air passageway 35. Exhaust ports 47 and 48 communicate with annular exhaust chamber 49 which is vented outwardly of the upper body 11 (such outward vent not being shown in the figure).

The air valve body 40 is provided with various O-rings as shown in the drawing for sealing the air valve body 40 to the bore 39 of the upper body 11. Moreover, the air valve body 40 is provided with an air fitting 50 adapted to be attached to a regulated supply of pressurized air at about 50 psig.

Spool 41 preferably has a land diameter of about 0.250 inches and will pass about 2 scfm at about 50 psig air supply pressure. Leakage air consumption at balance is preferably held to less than 0.25 scfm at the preferred supply pressure of about 50 psig. Spool 41 is loaded by the supply air pressure acting directly against the spool end and is thus pressed downwardly against the torquemotor 17 as will be described.

It will be appreciated that the sealing land 42 of the spool 41 is of such a dimension so as to seal off ports 44, 45 when the spool 41 is positioned at an equilibrium position as shown FIG. 1 in. The lower land 43 seals the internal bore 51 of the valve body 40 at a lower end thereof.

As will further be described, movement of the spool 41 controls the flow of pressurized control air in the passageways 35 and 36 to the port 37 beneath the piston 30. Specifically, when the spool moves downwardly, as viewed in FIG. 1, the ports 44, 45 are at least slightly uncovered, thereby permitting pressurized air into the chamber 46 and through port 38 into the passageways 35 and 36. At the same time, no air can escape around land 42 and down through the ports 47 and 48 for exhaustion.

Should the spool 41 move upwardly so that sealing land 42 opens ports 44, 45 beneath the land 42 and within the bore 51, any pressurized air within the passageway 35 will be exhausted through the ports 47, 48 and exhaust chamber 49.

The magnetic torquemotor 17 includes electrical control windings 55 and 56 connected through electrical terminals 57, 58 and connector 83 to a remote current source (not shown) of any suitable type. Torquemotor 17 is constructed to be operated through a deflection of about 0.012 inch from a centered equilibrium position on the basis of an electrical input on the order of 10 to 50 milliamperes of current. The electrical control device required is any linearly controllable current source capable of variably introducing such current over such range to the terminals of connector 83.

The torquemotor 17 includes permanent magnet 84 bonded to stator 85 and magnetized across its shortest dimension to furnish a constant magnetic field flux across air gaps 86 and 87. Magnet 84 is preferably constructed of Alnico 8 alloy which experiences no permanent change in material properties and very little reversible change in magnetization at 400° F. operating temperature.

The torquemotor 17 also includes armature 59 supported on rotationally compliant flexure bearings 60 (note only one shown). A torque arm 61 is mounted on armature 59 and can be preferably moved through a control stroke of about 0.012 inch as a full electrical control current is applied to windings 55 and 56. Adjusting screws 89 and centralizing springs 90 position armature 59 so that air gaps 86 and 87 are equalized when control windings 55 and 56 are deenergized.

Armature 59 and stator 85 are preferably constructed of a high permeability, low hysteresis magnetic alloy such as hydrogen annealed 49 percent ferronickel. Windings 55 and 56 are preferably constructed of high temperature insulated magnet wire wound on high temperature plastic or ceramic bobbins. Flexure bearings 60 and springs 90 are preferably constructed of high temperature spring alloy. Torque-motor 17 is rigidly mounted to cover 62 of upper body 11 by appropriate mounting flanges and fasteners 63.

When a properly polarized direct control current is applied to series connected windings 55 and 56 of torquemotor 17, a magnetic control flux is developed in air gaps 86 and 87, which flux reacts with the field flux furnished by magnet 84 to produce a torque on armature 59. This torque is linearly proportional to the control current.

The preferred torquemotor is of the so-called "dry type," in that all moving parts operate in air and do not contact the adhesive flowing through lower body 12. The control windings 55, 56 of the preferred torquemotor constitute about a 300 ohm series connected load. They develop a starting force of about 1.25 pounds at a control current of about 50 milliamperes, and they are intended to operate over a full control current range of about 10 to about 50 milliamperes direct current. When operated at maximum current, control power is about 0.75 watts at room temperature and about 1.3 watts at a copper temperature of 428° F. Nominal temperature rise at 1.3 watts is less than 36° F.

At this point, it is important to note that torque arm 61 is directly disposed between the lower end 52 of valve spool 41 and the upper end 18*a* of feedback spring 18 as viewed in FIG. 1. As will be further explained, spring 18 constitutes a direct mechanical means for closed loop feedback of the position of valve stem 25 to torquemotor 17 and air valve 16. Spring 18 is initially preloaded to balance the force exerted on arm 61 by spool 41 and torque-motor 17 when valve 15 is closed, windings 55 and 56 are energized with about 10 milliamperes direct current and air supply pressure is about 50 psig.

Spring 18 is preferably a constant rate linear performance compression spring capable of exerting a linearly changing force between piston 30 and arm 61 as the position of stem 25 is changed. The preferred spring 18 is constructed of a suitable high temperature spring alloy such as 17-7 PH stainless steel, which maintains nearly constant elastic properties up to a working temperature of 400° F.

Consider now the operation of the flow control gun 10 from an initial condition with the gun in a closed state and with no electrical current being supplied to the windings 55 and 56 of torquemotor 17. In this preliminary condition, the preload force exerted by spring 18 on arm 61 is sufficient to cause sealing land 42 of spool 41 to be moved upwardly a slight distance from the equilibrium position illustrated in FIG. 1, thereby exhausting air from beneath piston 30 and blocking the flow of pressurized air through fitting 50 beyond land 42.

When it is desired to dispense adhesive, a source of pressurized hot melt adhesive is connected to the port 75 in lower body 12. Adhesive fills the adhesive chamber 76 where it is heated by the heater H and maintained at operating temperature. Due to the contact, however, of the control plug 26 with the seat 80 of bore 71, no adhesive escapes through nozzle 19.

When it is desired to commence flow, sufficient current is supplied to windings 55 and 56 of torquemotor 17, to overcome the force of spring 18 and to pivot the torque arm 61 in a counterclockwise direction about the bearings 60. This counterclockwise motion permits the air loaded spool 41 to move downwardly, following the torque arm 61, until land 42 blocks the ports 44 and 45, as shown in FIG. 1. As motion of arm 61 continues, the land 42 clears the upper edge of the ports 44 and 45 by a slight distance and pressurized air is admitted to the chamber 46, the port 38, air passageways 35 and 36, and port 37 to beneath the piston 30. This air pressure causes the piston 30 to rise accordingly.

The rising piston 30 pulls with it the stem 25, thereby pulling the plug 26 away from the seat 80 and opening the bore 71 to permit adhesive to flow therethrough to the nozzle 19 for dispensing. As the piston 30 rises, however, it compresses spring 18 which exerts an increasing feedback force on the torque arm 61, causing the torque arm to raise slightly and to reposition the sealing land 42 so as to again block the ports 44 and 45. Blocking the ports 44 and 45 maintains a constant pressure within the passageways 35 and 36 and maintains the piston 30 in its predisposed position according to the force of the torque arm 61 as maintained by the applied current. Accordingly, hot melt adhesive flows through the nozzle 19 in such an amount as was selected by the force exerted by the torque arm 61.

The magnitude of the force of the torque arm 61 is selected by the current supplied to the windings 55 and 56 of the torquemotor 17. A current of 10 milliamperes is considered to be the normal operating current above which a sufficient force is developed to cause movement of control plug 26. Any current input between 10 milliamperes and 50 milliamperes will cause a linearly corresponding torque arm force with the resulting position of the control plug 26 being linearly proportional to the current supplied to the torque motor 17 within the selected range as noted above. This linearity is generated as a result of the linear performance of the feedback spring 18, the closed loop feedback controlled application of pressure through the air valve 16, and the inherent linearity of the torque motor 17, as described.

It has been found that this particular arrangement, according to the specific construction illustrated, provides an extremely stiff valve positioning action such that it takes a force of more than 10 pounds to displace the valve stem 25 more than 0.02 inches from an initial longitudinal position corresponding to the current applied to the windings 55 and 56. This high system stiffness serves to resist any unbalanced pressure force applied to the control plug 26 by the flowing pressurized adhesive, and thereby to maintain a constant adhesive flow through control valve 15, event at high operating adhesive supply pressures and flows.

When it is desired to stop the flow through the nozzle 19, the current to the windings 55 and 56 is cut off. This permits the torque arm 61 to rise to a position such that it pushes the spool 41 slightly upwardly. Land 42 clears the bottoms of ports 44 and 45 and permits air in the passageways 35 and 36 to exhaust through the bore 51 of the valve body 40, ports 47, 48, and chamber 49. As this air pressure exhausts, the piston 30 is moved downwardly by the action of the return spring 27 and the feedback spring 18, until the control plug 26 strikes seat 80, closing off the bore 71 and stopping the flow of hot melt adhesive through nozzle 19.

Of course, if it is desired to change the flow through the nozzle 19, it is only necessary to vary the amount of the current supplied to the coils 55 and 56 of the torquemotor 17 within the range of 10 to 50 milliamperes. For example, if the gun 10 is flowing adhesive and it is necessary to obtain an increased flow, it is only necessary to increase the current input to torquemotor 17. This increases the force of torque arm 61, causing the control plug 26 to withdraw further from the bore 71 and thereby increasing the flow through the nozzle 19. In a likewise fashion, decreasing current to the torquemotor 17 decreases the force of torque arm 61, thus causing the control plug 26 to be inserted further into the bore 71 and thereby reducing the flow through nozzle 19. After any such change, torque arm 61 is again returned to a balanced equilibrium position at which the sealing land 42 blocks the ports 44 and 45 and prevents further motion of control plug 26. At this point, the feedback loop is balanced between the torquemotor force, the air pressure force exerted by spool 41 and the force exerted by spring 18 to maintain control plug 26 in a position which corresponds directly and linearly to the amount of current introduced to torquemotor 17.

It has been found that the speed of response of this apparatus, according to the specific construction illustrated, is very rapid such that control plug 26 can be positioned anywhere over its full range of motion of 0.25 inches, from fully open to fully closed in about 50 milliseconds. This rapid speed of response serves to quickly start, stop or change flow through control valve 15, as may be required by the dispensing application.

In another aspect of the invention, it will be appreciated that the tapered flow control plug 26, when inserted in control bore 71, presents a variable area restrictive obstruction to the flow of hot melt adhesive through valve 15. It will also be appreciated that the shape of plug 26, as it interacts with bore 71, determines the precise flow area which will be achieved when control plug 26 is positioned at any point over the full range of movement of stem 25. Therefore, since it is desired to achieve a flow area which is linearly proportional to the position of plug 26 about seat 80, the plug 26 is shaped to provide such linear area-to-stem position relationship. One flow control plug which will achieve this linear relationship is illustrated in FIG. 3, which shows a nearly conical blunt end bullet-shaped metering tip **26*a* with a true conical sealing surface 26*b* at its upper end for contacting seat 80 and preventing the flow of adhesive through nozzle 19 when plug 26** is fully seated. Other examples of linear flow control plugs can be found in "Principles of Industrial Process Control" by D. P. Eckman and published by John Wiley and Sons, Inc., incorporated herein by reference in order to show the state of the art, and in other well known references as well.

In a further aspect of the invention, it will be appreciated that control plug 26 provides variable flow area which is maximized when stem 25 is moved to the uppermost position permitted by the valve stem positioning mechanism. Likewise, it will be appreciated that nozzle 19 has a fixed effective flow area determined by the diameter of outlet port 81. As will be recognized by one skilled in the art, the proportionality between flow through nozzle 19 and the position of stem 25 will be affected, to a greater or lesser extent, by the ratio between the maximum flow area of valve 15 and the fixed flow area of nozzle 19. In particular, if the flow area of nozzle 19 is smaller than the maximum flow area of valve 15, the flow may become highly non-linear with respect to the position of stem 25. This flow nonlinearity is attributable to the relative pressure drop which occurs across each obstructive restriction in the system and will be decreased as dispensing nozzle flow area is increased relative to control valve flow area.

Accordingly, the invention provides for a linear flow control apparatus wherein the fixed dispensing nozzle flow area is equal to or greater than the maximum flow area of valve 15. The effect of utilizing a larger or smaller nozzle area in this range is to increase or decrease the linearity of adhesive flow versus valve opening. For example, a dispensing nozzle equal in area to the maximum flow area of valve 15 may experience as much as a 29% nonlinearity, while a nozzle with a flow area two times greater than valve 15 will experience less than a 5% nonlinearity. In this manner, the invention provides for a more linear flow control action across the full range of flow control valve openings, by selection of the particular dispensing nozzle size for the application.

Moreover, it will be appreciated, as discussed herein, that the accuracy of the proportional flow control provided by the invention is affected by the pressure drop across the valve. Since the flow through the valve is determined by pressure, changes in pressure result in a change in flow. Accordingly, it will be appreciated that the invention provides a more accurate control when used with pressure sources producing pressures which are held as constant as possible. Systems known as constant pressure sources are readily available commercially, and do not constitute any part of this invention.

In considering the alternative embodiment of FIG. 2, the air valve 16, as described with respect to FIG. 1, is an unbalanced valve due to the force of the air pressure from the source as shown in FIG. 1. In the alternative embodiment shown in FIG. 2, a balanced air valve 100 is used in place of unbalanced valve 16. Valve 100 includes a valve body 101 and a spool 102 having three sealing lands 103, 104 and 105. Lower end 106 of spool 102 rests on torque arm 61 of the torque motor 17 (not shown in FIG. 1). Valve body 101 is provided with exhaust ports 107 and 108, supply port 109, and output port 110.

An adjusting nut 111 is provided at one end of body 101 in line with spool 102. Spring 112, is disposed between the nut 111 and spool 102 and is preferably a linear performance spring to maintain the overall linear response of the system.

In use, the upper body 11 of the gun 10 is configured to receive a valve body 101 in an operative disposition, and has appropriate porting which connect exhaust ports 107, 108 with a vent, the supply port 109 to a source of pressurized control air and output port 110 with port 38 to passageway 35 (FIG. 1). Otherwise, gun 10 is identical to that as shown in FIG. 1.

In use, pressurized air is supplied to port 109. This pressure reacts on lands 103 and 104 in opposite directions, the opposite side of these lands being vented to atmosphere via ports 107, 108, respectively. The spool 102, however, does not move since the forces exerted are equal. The spool 102 is thus balanced against the forces of air pressure. Adjusting nut 111 is turned to compress spring 112 and thereby to bias spool 102 against torque motor arm 61. The bias force balances spool 102 in a position to block port 110 when valve 15 is closed and windings 55 and 56 are energized with about 10 milliamperes direct current. Thereafter, the valve 100 operates in the same way as valve 16 with respect to opening, closing or changing flow through valve 15. Use of such an alternative air valve eliminates the need for a regulated pressure source of operating air and permits the use of either higher or lower pressure air sources to operate the gun. This is particularly advantageous where increased actuating force is desired or where lack of regulated air supply pressure makes it impractical to use valve 16. It should be noted that valve 100 is somewhat longer than valve 16 and may increase the overall length of the gun. Additionally, valve 100 may cause a slightly increased air leakage at balance because of the use of two sealing lands on opposite sides of the pressurized port.

The advantages obtained by the invention, as described, are numerous. For example, gun 10 provides fully remote selection of adhesive flow, permitting its use in a machine location where the dispensing gun may be at a distance or otherwise inaccessible to an operator. It can be readily applied to vary hot melt adhesive bead width in response to any substrate or gun mover speed change which can be sensed and transmitted electrically. It is readily interfaceable with programmable controllers or digital computers. Moreover, it utilizes very low power electrical control circuitry, since the electrical load imposed by the torquemotor is less than 1.5 watts at worst case. This low power operation is additionally beneficial because it reduces the heat developed in torquemotor components and thereby prolongs their life and improves their stability.

Gun 10, as described, is also heated and temperature controlled so that adhesive properties are maintained more nearly constant. In particular, adhesive viscosity changes are minimized, thus holding flow more nearly constant. Also, temperature dependent control forces and displacements are held more nearly constant, further increasing the accuracy and repeatability of adhesive flow control.

Gun 10, as described, is extremely fast acting in response and provides a very stiff closed loop valve positioning action. This stiff action further minimizes changes in flow caused by high operating adhesive supply pressures and flows. Moreover, the control mechanism is rigidly mounted and internally balanced to resist flow disturbing control element movements introduced by vibration, acceleration or gun inclination.

Gun 10, as described, utilizes a rugged mechanical spring feedback means, completely internal to the gun body, to maintain closed loop control of valve stem position, thereby avoiding the need for external electric valve stem position feedback. This plays a significant part in reducing the complexity and overall cost of the apparatus. Additionally, the gun is self-closing by reason of return springs, thus is inherently fail-safe in operation should a control signal or air pressure outage be experienced.

Gun 10, as described, utilizes a simply constructed single-stage, closed-center, spool-type air control valve in lieu of a two-stage air amplifier with open-center flapper-nozzle air control elements. This is significant in reducing air consumption at balance and improving the economy of operation. Furthermore, the speed of response is increased compared to the two-stage construction. As previously mentioned, gun 10 can alternatively be furnished with a balanced air valve construction which avoids the use of regulated air supply pressure and permits higher or lower air supply operating pressures.

Moreover, gun 10 is very compact and lightweight in construction, thereby facilitating installation in a limited space and permitting its use in weight limited applications such as robotics.

Finally, gun 10 provides either on-off or fully proportional control action. As previously mentioned, the speed of response is sufficiently fast to permit its use in applications previously served only by high speed, fixed stroke, constant flow dispensing guns. Because of its remote electrical control capability, the gun can, if desired, be utilized as a linear servo-control element in a closed loop flow control system employing remote electrical flow sensing and remote external electrical feedback.

These and other modifications and advantages will become readily apparent to those of ordinary skill in the art to which this invention pertains, and applicant thus intends to be bound only by the claims appended hereto.

What is claimed is:

1. Proportional flow fluid dispensing apparatus comprising:

a piston;

a flow control valve means having a valve stem operably connected to said piston for controlling the flow of the fluid;

a passageway for pressurized air opening to one side of the piston;

an air valve means for controlling the flow of pressurized air into said passageway;

a direct mechanical spring feedback means;

a linear effort electric torquemotor means operably disposed in a position between said mechanical spring feedback means and said air valve means for directly stroking said air valve means, said direct mechanical spring feedback means being operably disposed between said piston and said linear torquemotor means for positioning said air valve means to block said passageway after said valve stem has been moved to a position linearly corresponding to the force exerted by said torquemotor, wherein said air valve means comprises a valve body and a balanced, three land spool reciprocally mounted in said valve body, said valve body having an exhaust port, a supply port and a load port, the outermost of such lands being directly exposed on outwardly facing sides to atmospheric pressure, and the innermost of such lands adjacent said load port, said innermost land selectively sealing such load port and wherein one face of said innermost land is directly exposed to said supply port and one face of said innermost land is directly exposed to said exhaust port.

2. Proportional flow fluid dispensing apparatus as in claim 1, wherein said air valve means further comprises a variable spring loaded adjustment element engaging one end of said spool, the other end of said spool engaging said torquemotor.

* * * * *